US009809996B2

(12) United States Patent
Ohl et al.

(10) Patent No.: US 9,809,996 B2
(45) Date of Patent: Nov. 7, 2017

(54) SYSTEM AND METHOD FOR ASSEMBLING A DOOR LOCK

(75) Inventors: James D. Ohl, Colorado Springs, CO (US); Nathanael S. Murphy, Colorado Springs, CO (US)

(73) Assignee: Schlage Lock Company LLC, Indianapolis, IN (US)

( * ) Notice: Subject to any disclaimer, the term of this patent is extended or adjusted under 35 U.S.C. 154(b) by 246 days.

(21) Appl. No.: 14/006,822

(22) PCT Filed: Mar. 22, 2011

(86) PCT No.: PCT/US2011/029338

§ 371 (c)(1),
(2), (4) Date: Sep. 23, 2013

(87) PCT Pub. No.: WO2012/128756

PCT Pub. Date: Sep. 27, 2012

(65) Prior Publication Data

US 2014/0008922 A1 Jan. 9, 2014

(51) Int. Cl.

| | |
|---|---|
| ***E05B 9/00*** | (2006.01) |
| ***E05B 9/08*** | (2006.01) |
| ***E05B 63/10*** | (2006.01) |
| ***E05B 9/02*** | (2006.01) |

(52) U.S. Cl.

CPC ..... *E05B 9/08* (2013.01); *E05B 9/02* (2013.01); *E05B 63/10* (2013.01); *Y10T 292/62* (2015.04)

(58) Field of Classification Search

USPC ..... 292/337, 336.3, 356, 348, 347

See application file for complete search history.

(56) References Cited

U.S. PATENT DOCUMENTS

| | | | | |
|---|---|---|---|---|
| 1,829,815 | A * | 11/1931 | Schlage | 292/337 |
| 2,723,874 | A * | 11/1955 | Hillgren | E05C 1/163 292/169.17 |
| 4,854,620 | A * | 8/1989 | Dunphy et al. | 292/337 |
| 5,685,182 | A | 11/1997 | Chhatwal | |
| 5,775,745 | A * | 7/1998 | Hoppe et al. | 292/138 |
| 7,275,773 | B1 * | 10/2007 | Weathersby et al. | 292/337 |
| 2005/0006912 | A1 | 1/2005 | Huang | |
| 2010/0050718 | A1 | 3/2010 | Boesel et al. | |

FOREIGN PATENT DOCUMENTS

| | | | |
|---|---|---|---|
| KR | 100710924 | B1 | 4/2007 |

OTHER PUBLICATIONS

International Search Report and Written Opinion for corresponding International Application No. PCT/US2011/029338 dated Nov. 15, 2011.

* cited by examiner

*Primary Examiner* — Mark Williams
(74) *Attorney, Agent, or Firm* — Michael Best & Friedrich LLP

(57) ABSTRACT

A door lock assembly is configured for installation in a cross bore of a door. The lock assembly includes a lock housing including a disk portion having an outer perimeter and an inner wall extending from the disk portion and defining an annular space between the inner wall and the outer perimeter and a lock space inside of the inner wall. The inner wall is sized to fit within the cross bore and define an annular gap between the inner wall and the cross bore. A retention clip is removably attached to the lock housing and includes a retention portion that engages the cross bore to removably retain the lock housing within the cross bore without the use of fasteners.

28 Claims, 5 Drawing Sheets

SYSTEM AND METHOD FOR ASSEMBLING A DOOR LOCK

BACKGROUND

The present invention relates to a system and method for assembling a door lock. More particularly, the invention relates to a system and method for retaining a lock assembly in position during assembly of the lock into the door.

Door locks are typically installed in a cross bore of a door panel. The door lock typically includes an inside portion and an outside portion that attach to one another and engage the door panel. During assembly, it is often necessary for the assembler to both hold one of the portions in place and adjust a fastener. This process can be difficult and sometimes results in misalignment or other problems with the assembly.

SUMMARY

In one embodiment, the invention provides a door lock assembly configured for installation in a cross bore of a door. The lock assembly includes a lock housing including a disk portion having an outer perimeter and an inner wall extending from the disk portion and defining an annular space between the inner wall and the outer perimeter and a lock space inside of the inner wall. The inner wall is sized to fit within the cross bore and define an annular gap between the inner wall and the cross bore. A retention clip is removably attached to the lock housing and includes a retention portion that engages the cross bore to removably retain the lock housing within the cross bore without the use of fasteners.

In another construction, the invention provides a door lock assembly configured for installation in a cross bore of a door. The lock assembly includes a lock housing including a disk portion having an outer perimeter and an inner wall extending from the disk portion and defining an annular space between the inner wall and the outer perimeter and a lock space inside of the inner wall. The inner wall is sized to fit within the cross bore and define an annular gap between the inner wall and the cross bore. A first retention clip is removably attached to the lock housing and a second retention clip is removably attached to the lock housing. The first retention clip and the second retention clip each simultaneously engage with the lock housing and the cross bore to retain and center the lock housing within the cross bore.

In another construction, the invention provides a door lock assembly configured for installation in a cross bore of a door. The lock assembly includes a lock housing having a disk portion having an outer perimeter and an inner wall extending from the disk portion and defining an annular space between the inner wall and the outer perimeter and a lock space inside of the inner wall. The inner wall is sized to fit within the cross bore and define an annular gap between the inner wall and the cross bore. A first retention clip is coupled to the lock housing and is completely disposed within the annular space and a second retention clip is coupled to the lock housing and is completely disposed within the annular space. The first retention clip and the second retention clip each include a biasing portion engaged with the cross bore to retain the lock housing within the cross bore without the use of fasteners.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Figure 1:
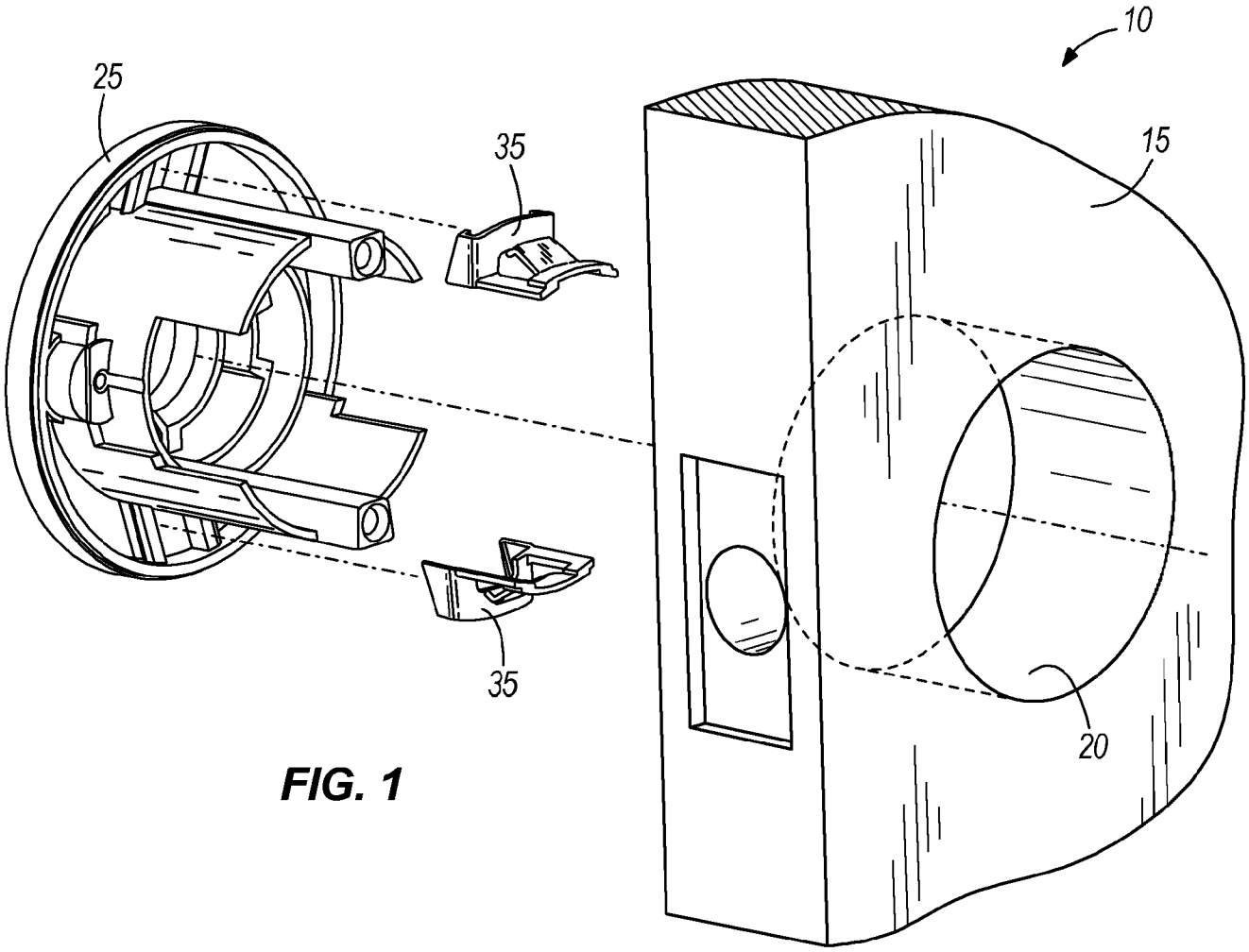
FIG. 1 is a perspective view of a portion of a door including a cross bore and a lock housing.

FIG. 1 illustrates a typical doorway 10 including a door panel 15 supported for pivotal movement within a door frame. The door panel 15 includes a cross bore 20 sized to receive a lock assembly. The lock assembly, once installed selectively engages the door frame to maintain the door panel 15 in a closed position.

The lock assembly includes an inside lock housing 25, an outside lock housing, a lock mechanism 30 (shown in FIG. 6), and two retention clips 35. The inside lock housing 25 and the outside lock housing are similar such that only one lock housing 25 will be described.

Figure 2:
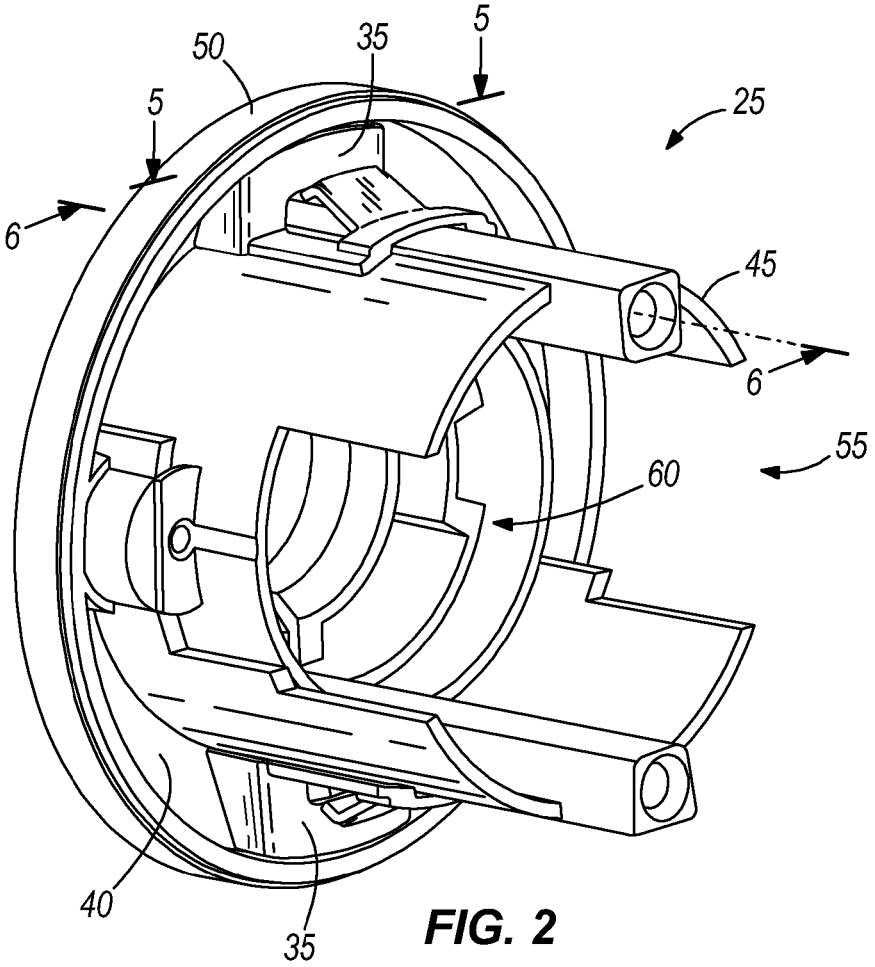
FIG. 2 is a perspective view of the lock housing of FIG. 1.

As illustrated in FIG. 2, the lock housing 25 (either inside or outside) includes a disk portion 40 and an inner wall 45 extending in a direction substantially normal to the disk portion 40. The disk portion 40 defines a substantially circular outer perimeter 50 with other shapes and arrangements being possible. The outer perimeter 50 is sized to cover the cross bore 20 and is arranged to receive a cover or escutcheon that covers the lock mechanism 30 and provides an aesthetic appearance.

The inner wall 45 is substantially cylindrical and includes two open side regions 55. The inner wall 45 is smaller than the outer perimeter 50 and is sized to fit within the cross bore 20 once the lock assembly is assembled within the door panel 15. The inner wall 45 defines a lock space 60 within the inner wall 45 that is sized to receive the lock mechanism 30.

Figure 4:
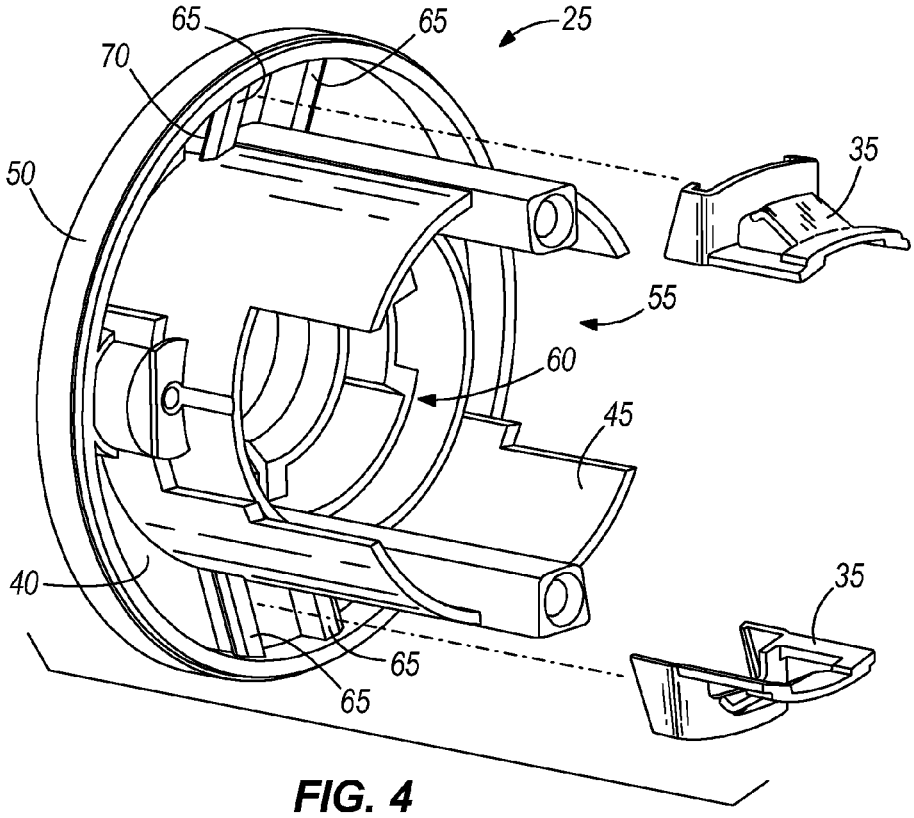
FIG. 4 is an exploded perspective view of the lock housing of FIG. 1 including two retention clips of FIG. 3.
Figure 5:
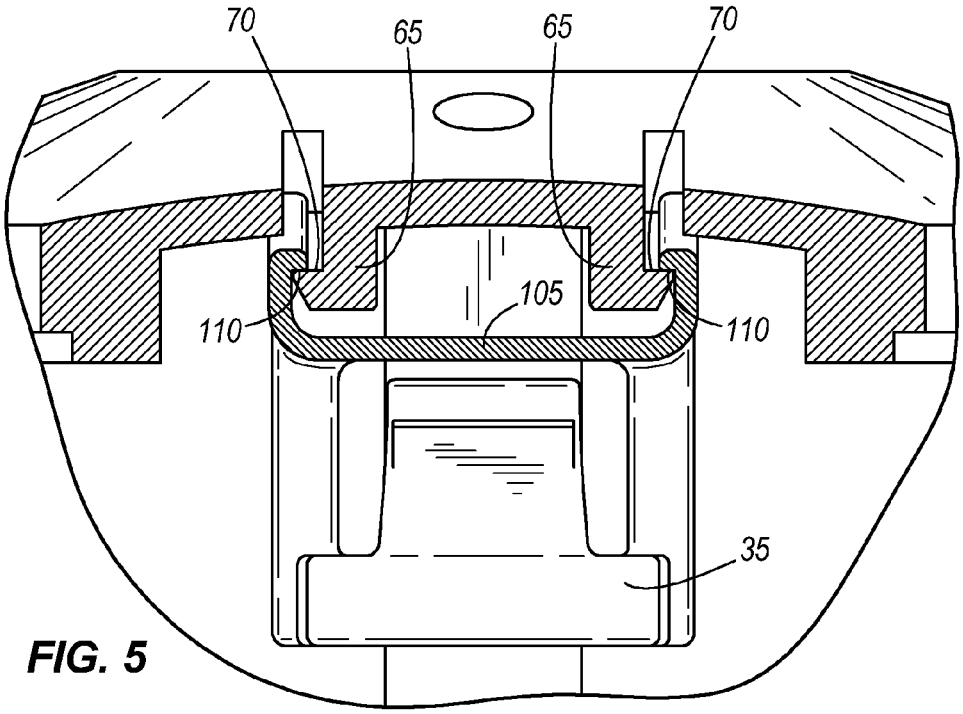
FIG. 5 is an enlarged partially broken away top view of the lock housing and retaining clip assembly.

A first pair of ribs 65, shown in FIG. 4, extends between the inner wall 45 and the disk portion 40. The ribs 65 are arranged at an oblique angle with respect to the inner wall 45 and the outer perimeter 50 of the disk portion 40. As illustrated in FIG. 5, each of the ribs 65 includes a hook portion 70 that extends away from the adjacent rib 65 of the pair. A second pair of ribs 65 extends between the inner wall 45 and the disk portion 40 and is positioned on the opposite side of the disk portion 40 as the first pair of ribs 65. The second pair of ribs 65 is substantially the same as the first pair of ribs 65 with each rib 65 including an outwardly facing hook 70. In some constructions, more that two pairs of ribs 65 may be employed. In the illustrated construction, the hook portions 70 of the ribs 65 are not uniformly spaced from the disk portion 40. Rather, the hook portions 70 are spaced a first distance from the disk portion 40 when measured near the inner wall 45 and are spaced a second distance from the disk portion 40 when measured near the outer perimeter 50, the second distance being larger than the first distance.

In preferred constructions, the disk portion 40, the inner wall 45, the first pair of ribs 65, and the second pair of ribs 65 are simultaneously formed as a single piece. For example, one construction forms the entire lock housing 25 using a casting process.

Figure 3:
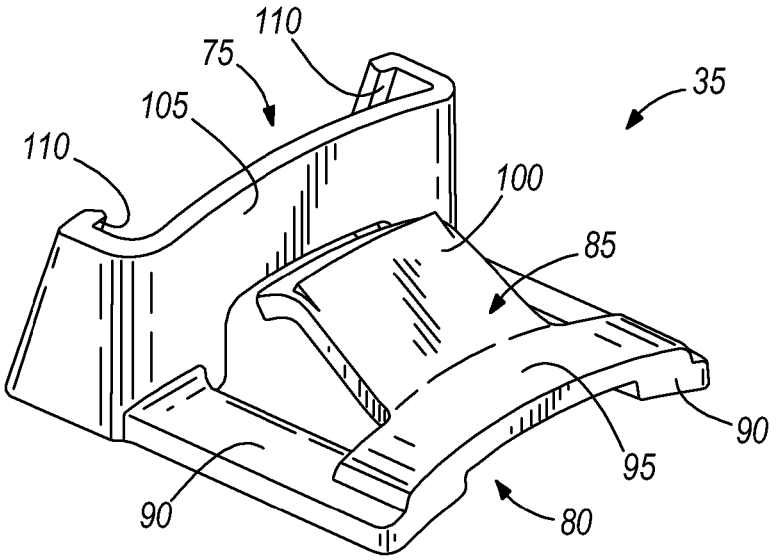
FIG. 3 is a perspective view of a retention clip.

The retention clip 35, illustrated in FIG. 3 includes and engagement portion 75, a base portion 80, and a biasing member 85. The base portion 80 includes two feet 90 that are spaced apart from one another and that are oriented such that the base 80 sits flat on the inner wall 45. Thus, the feet 90 are arranged to rest on a cylindrical surface in the illustrated construction. The engagement portion 75 extends between the feet 90 at one end of the retention clip with a cross member 95 extending between the feet 90 at the opposite end.

The biasing member 85 includes a leaf spring 100 that attaches to the cross member 95 and extends toward the engagement portion 75 and away from the base 80.

The engagement portion 75 defines a substantially C-shaped cross section that includes a spine portion 105 and two inward facing latches 110 positioned at each end of the spine portion 105. The latches 110 are oriented such that they define an oblique angle with respect to a radial line of the disk portion 40. As illustrated in FIG. 4, the orientation of the latches 110 matches the arrangement of the hooks 70 on the ribs 65.

The spine portion 105 extends between the latches 110 and has a slight bow when the retention clip 35 is not attached to the lock housing 25. The slight bow allows the engagement portion 75 to deflect slightly during assembly. Specifically, the bow allows the latches 110 to move apart from one another as they slide over the hooks 70 of the lock housing 25 during assembly. Thus, the retention clip 35 is able to snap into position and be fixedly retained in the engaged position as illustrated in FIGS. 4 and 5.

Figure 7:
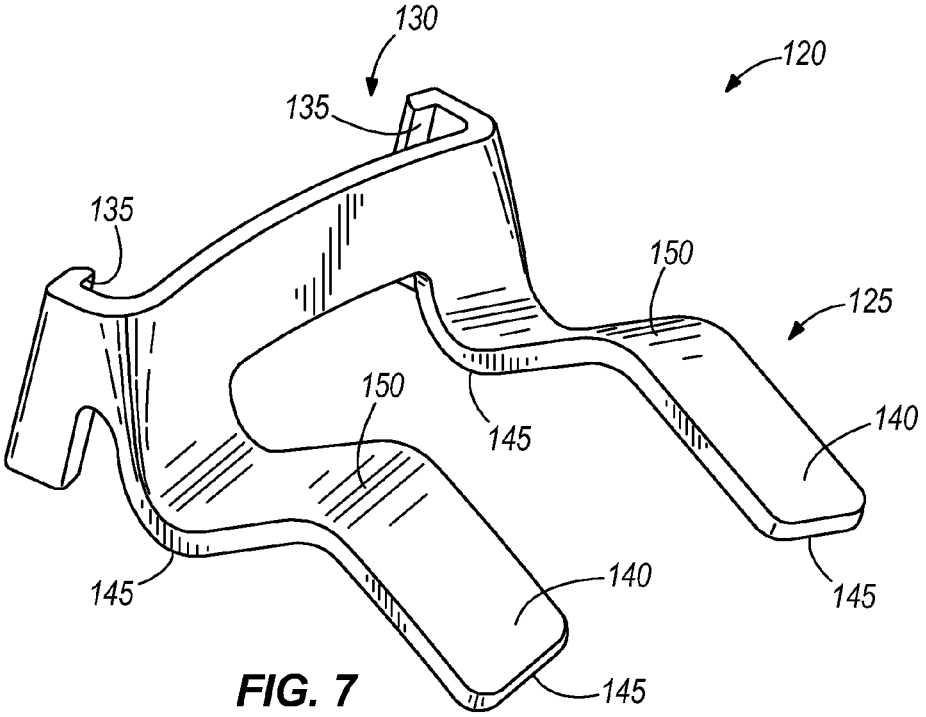
FIG. 7 is a perspective view of another retention clip.

As one of ordinary skill in the art will realize, other arrangements of retention clips 35 could be employed so long as the retention clip 35 is arranged to fit completely within an annular space 115 defined between the inner wall 45 and the cross bore 20. FIG. 7 illustrates one possible alternative retention clip 120. The retention clip 120 of FIG. 7 includes a biasing portion 125 and an engagement portion 130. The engagement portion 130 is similar to the engagement portion 75 of the retention clip 35 of FIG. 3 and includes two latches 135 arranged to engage the hooks 70 of the lock housing 25.

The biasing portion 125 includes two feet 140 that are arranged to engage the inner wall 45 of the lock housing 25 and that operate as a biasing member. Specifically, the feet 140 each include two contact points 145 that contact the inner wall 45 and a raised portion 150 that engages the cross bore 20 and holds the lock housing 25 in position when assembled into the cross bore 20.

Figure 8:
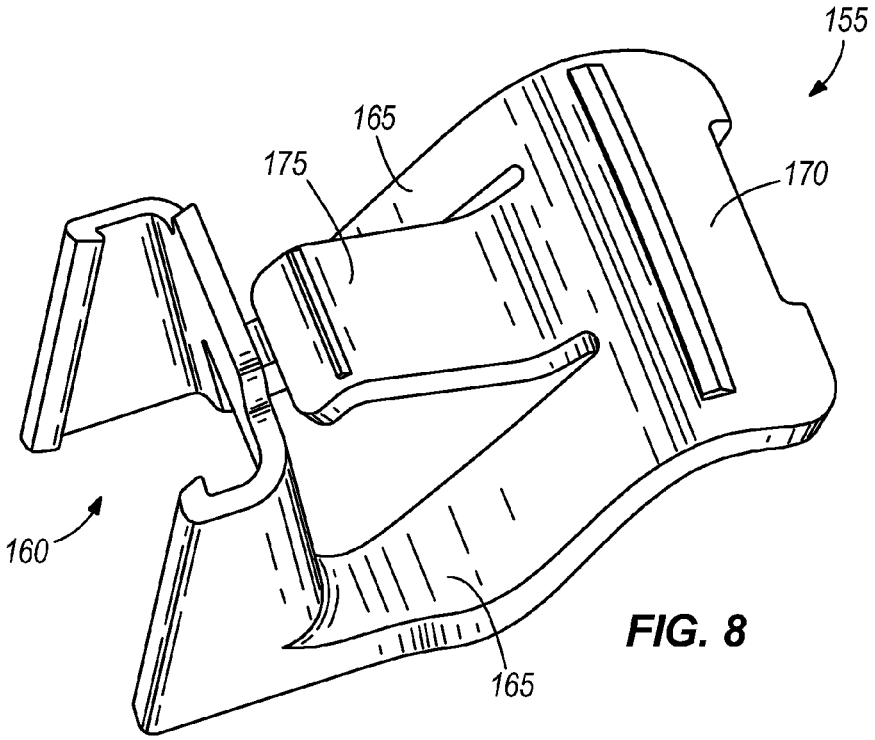
FIG. 8 is a perspective view of another retention clip.

FIG. 8 illustrates yet another arrangement of a retention clip 155 that includes an engagement portion 160 similar to the engagement portion 75 of the clip of FIG. 3. Two feet 165 extend from the engagement portion 160 and are connected by a cross member 170. A biasing member 175 extends from the cross member 170 toward the engagement portion 160 and between the two feet 165. In the construction of FIG. 8, a portion of each of the feet 165 is bent away from the surface on which the feet 165 rest. Thus, the feet 165 are able to provide some biasing force and the biasing member 175 is able to provide some biasing force.

Figure 6:
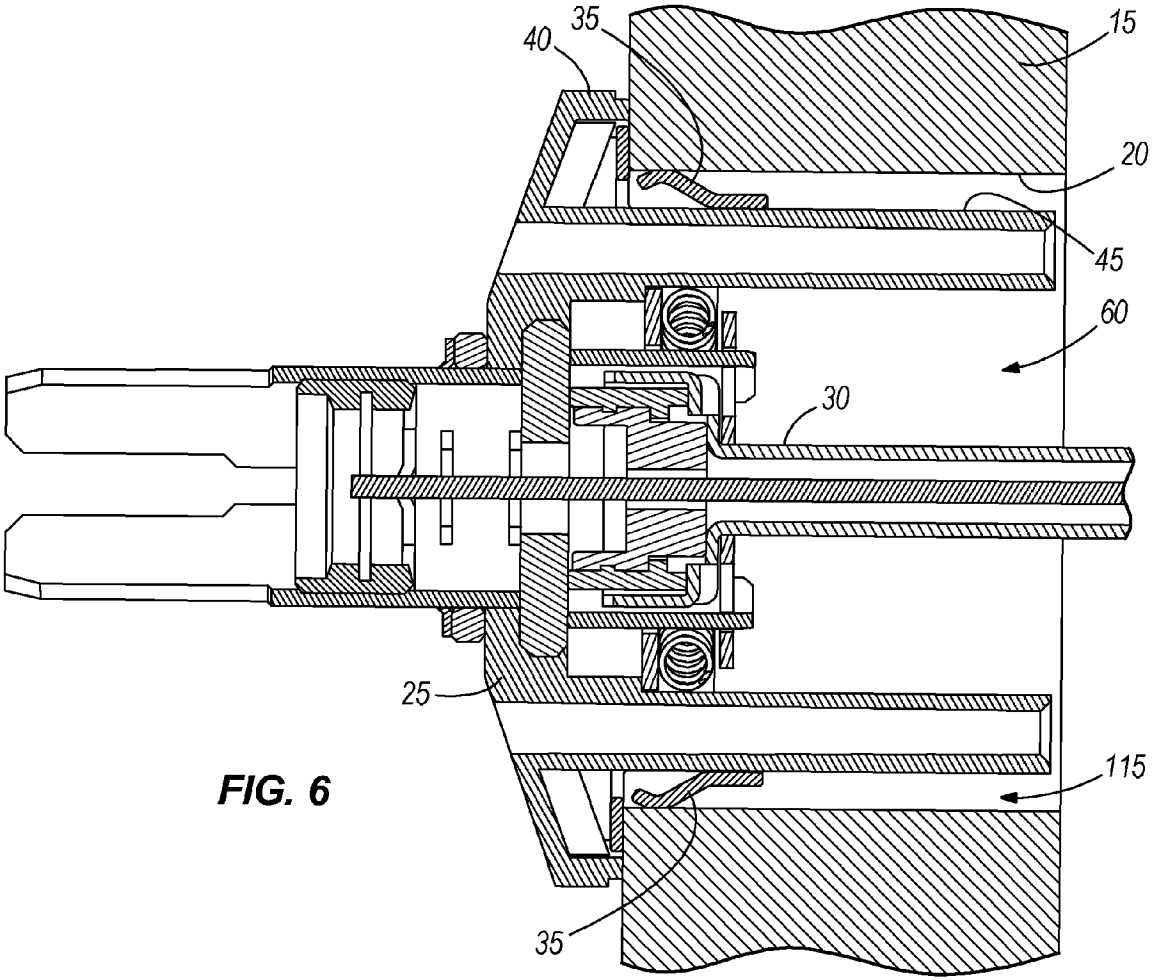
FIG. 6 is a section view of a lock assembly taken along a plane through a long axis of the cross bore.

To assemble the lock assembly into the door 15, the user first attaches the retention clips 35, 120 to the lock housing 25 by snapping the retention clips 35, 120 into position by engaging the latches 110, 135 and the hooks 70 as illustrated in FIG. 6. The retention clips 35, 120 are sandwiched between the inner wall 45 and the cross bore 20. As the user installs the lock housing 25 into the cross bore 20, the biasing members 85, 125 engage the cross bore 20 and are deflected toward the inner wall 45. As the biasing members 85, 125 deflect, they produce a force normal to the cross bore 20 that holds the lock housing 25 in position during assembly. The user is then free to perform the remaining assembly steps without holding the lock housing 25 in position.

Thus, the invention provides, among other things, a lock assembly that includes a retention clip 35, 120 that holds the lock housing 25 in position during assembly. It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined herein and by the following claims.

What is claimed is:

1. A door lock assembly configured for installation in a cross bore of a door, the lock assembly comprising:
- a lock housing including
  - a disk portion having an outer perimeter, the disk portion configured to be positioned outside the cross bore when attached to the door; and
  - an inner wall extending from the disk portion and defining an annular space between the inner wall and the outer perimeter and a lock space inside of the inner wall, the inner wall sized to fit within the cross bore and define an annular gap between the inner wall and the cross bore;
- a retention clip removably attached to the lock housing and including a retention portion that is engageable with an interference fit with the cross bore to removably retain the lock housing centered within the cross bore without the use of fasteners.

2. The door lock assembly of claim 1, wherein the retention clip is disposed completely within the annular space.

3. The door lock assembly of claim 1, further comprising a lock mechanism disposed completely within the lock space.

4. The door lock assembly of claim 1, wherein the retention clip includes an engagement portion having a C-shaped cross section, the engagement portion engageable with the disk portion to retain the retention clip in the annular space.

5. The door lock assembly of claim 1, wherein the disk portion includes two hook members positioned to engage the C-shaped engagement portion to retain the retention clip.

6. The door lock assembly of claim 4, wherein the retention clip includes a base portion that engages the inner wall and supports the retention portion.

7. The door lock assembly of claim 6, wherein the inner wall is substantially cylindrical and the base portion is curved to substantially match the inner wall.

8. The door lock assembly of claim 7, wherein the engagement portion includes a biasing member that deflects in response to contact with the cross bore.

9. The door lock assembly of claim 8, wherein the biasing member includes a leaf spring.

10. The door lock assembly of claim 1, further comprising a second retention clip, wherein the retention clip and the second retention clip cooperate to retain the lock housing within the cross bore.

11. The door lock assembly of claim 10, wherein the engagement portion includes a first biasing member and the second retention clip includes a second biasing member, the first biasing member and the second biasing member each deflecting in response to contact with the cross bore to produce a biasing force normal to an axis of the cross bore to retain the lock housing within the cross bore.

12. A door lock assembly configured for installation in a cross bore of a door, the door having an outer surface that is perpendicular to the cross bore, the lock assembly comprising:

a lock housing including
- a disk portion having an outer perimeter, the disk portion being configured to abut the outer surface of the door; and
- an inner wall extending from the disk portion and defining an annular space between the inner wall and the outer perimeter and a lock space inside of the inner wall, the inner wall sized to fit within the cross bore and define an annular gap between the inner wall and the cross bore;

a first retention clip removably attached to the lock housing; and a second retention clip removably attached to the lock housing, the first retention clip and the second retention clip each simultaneously engaged with the lock housing and defining an interference fit with the cross bore to retain and center the lock housing within the cross bore.

13. The door lock assembly of claim 12, wherein the first retention clip and the second retention clip are each disposed completely within the annular space.

14. The door lock assembly of claim 12, further comprising a lock mechanism disposed completely within the lock space.

15. The door lock assembly of claim 12, wherein the first retention clip includes an engagement portion having a C-shaped cross section, the engagement portion engageable with the disk portion to retain the first retention clip in the annular space.

16. The door lock assembly of claim 12, wherein the disk portion includes two hook members positioned to engage the C-shaped engagement portion to retain the first retention clip.

17. The door lock assembly of claim 15, wherein the first retention clip includes a base portion that engages the inner wall and supports the retention portion.

18. The door lock assembly of claim 17, wherein the inner wall is substantially cylindrical and the base portion is curved to substantially match the inner wall.

19. The door lock assembly of claim 18, wherein the engagement portion includes a biasing member that deflects in response to contact with the cross bore.

20. The door lock assembly of claim 19, wherein the biasing member includes a leaf spring.

21. The door lock assembly of claim 12, wherein the first retention clip includes a first biasing member and the second retention clip includes a second biasing member, the first biasing member and the second biasing member each deflecting in response to contact with the cross bore to produce a biasing force normal to an axis of the cross bore to retain the lock housing within the cross bore.

22. A door lock assembly configured for installation in a cross bore of a door, the cross bore having a circular cross section, the lock assembly comprising:

a lock housing including
- a disk portion having an outer perimeter; and
- an inner wall extending from the disk portion and defining an annular space between the inner wall and the outer perimeter and a lock space inside of the inner wall, the inner wall sized to fit within the cross bore and define an annular gap between the inner wall and the cross bore;

a first retention clip coupled to the lock housing and completely disposed within the annular space;

a second retention clip coupled to the lock housing and completely disposed within the annular space, the first retention clip and the second retention clip each including a biasing portion that defines an interference fit with the cross bore to position the lock housing within the cross bore without the use of fasteners.

23. The door lock assembly of claim 22, wherein the first retention clip includes an engagement portion having a C-shaped cross section, the engagement portion engageable with the disk portion to retain the first retention clip in the annular space.

24. The door lock assembly of claim 22, wherein the disk portion includes two hook members positioned to engage the C-shaped engagement portion to retain the first retention clip.

25. The door lock assembly of claim 23, wherein the first retention clip includes a base portion that engages the inner wall and supports the retention portion.

26. The door lock assembly of claim 25, wherein the inner wall is substantially cylindrical and the base portion is curved to substantially match the inner wall.

27. The door lock assembly of claim 22, wherein each of the biasing member includes a leaf spring.

28. The door lock assembly of claim 22, wherein the first retention clip includes a first biasing member and the second retention clip includes a second biasing member, the first biasing member and the second biasing member each deflecting in response to contact with the cross bore to produce a biasing force normal to an axis of the cross bore to retain the lock housing within the cross bore.

* * * * *